US008091727B2

(12) United States Patent
Domkowski

(10) Patent No.: US 8,091,727 B2
(45) Date of Patent: Jan. 10, 2012

(54) SNAP-OVER CLAMSHELL PROTECTIVE PORT CAP

(75) Inventor: John A. Domkowski, Kenosha, WI (US)

(73) Assignee: Hospira, Inc., Lake Forest, IL (US)

( * ) Notice: Subject to any disclaimer, the term of this patent is extended or adjusted under 35 U.S.C. 154(b) by 575 days.

(21) Appl. No.: 12/264,398

(22) Filed: Nov. 4, 2008

(65) Prior Publication Data

US 2009/0120934 A1 May 14, 2009

Related U.S. Application Data

(60) Provisional application No. 60/986,341, filed on Nov. 8, 2007.

(51) Int. Cl.
*B65D 45/32* (2006.01)

(52) U.S. Cl. ..... 220/320; 215/274; 215/251

(58) Field of Classification Search ..... 215/251, 215/253, 277, 275, 249, 273, 274; 220/314, 220/319, 320
See application file for complete search history.

(56) References Cited

U.S. PATENT DOCUMENTS

| | | | | |
|---|---|---|---|---|
| 811,824 | A | | 2/1906 | Clay |
| 811,825 | A | | 2/1906 | Clay |
| 816,170 | A | | 3/1906 | Maxwell |
| 1,191,567 | A | | 7/1916 | Clay |
| 1,239,223 | A | | 9/1917 | Ross |
| 1,259,255 | A | | 3/1918 | McLachlan |
| 1,381,363 | A | | 6/1921 | Taliaferro |
| 1,512,347 | A | | 10/1924 | Lorenz |
| 1,512,348 | A | | 10/1924 | Lorenz |
| 1,609,078 | A | | 11/1926 | Floyd |
| 1,720,835 | A | | 7/1929 | Holmdahl |
| 2,408,465 | A | | 10/1946 | Lauve |
| 3,071,275 | A | | 1/1963 | Foss et al. |
| 3,443,735 | A | * | 5/1969 | Meijers ..... 229/117.27 |
| 3,618,802 | A | | 11/1971 | Yates, Jr. |
| 3,795,360 | A | | 3/1974 | Bianchi et al. |
| 3,888,377 | A | | 6/1975 | Stadler |
| 3,924,772 | A | * | 12/1975 | Magnani ..... 215/276 |
| 4,005,739 | A | | 2/1977 | Winchell |
| 4,068,696 | A | | 1/1978 | Winchell |
| 4,140,148 | A | | 2/1979 | Richter |
| 4,194,640 | A | | 3/1980 | Crankshaw et al. |
| 4,271,972 | A | | 6/1981 | Thor |
| 4,286,640 | A | | 9/1981 | Knox et al. |
| 4,457,445 | A | * | 7/1984 | Hanks et al. ..... 220/214 |
| 4,759,756 | A | | 7/1988 | Forman et al. |

(Continued)

FOREIGN PATENT DOCUMENTS

EP 324573 B1 7/1989

(Continued)

*Primary Examiner* — Anthony Stashick
*Assistant Examiner* — Kareen Rush
(74) *Attorney, Agent, or Firm* — Michael R. Crabb

(57) ABSTRACT

A single-use, clamshell protective cap for use primarily in healthcare settings in order to maintain the integrity of a medication solution. The cap has two halves, a cylindrical skirt, a puncture resistant lid portion, an interior flange, and an interlocking snap. When placed around a flanged injection port such as is found on a conventional fluid container and closed, the lid portion covers an access site on an injection port. After the cap is placed, the interior flange engages the port flange to prevent upward axial movement relative to the port, thereby preventing removal of the cap and thus deterring unwanted or erroneous drug administrations or withdrawals.

12 Claims, 7 Drawing Sheets

U.S. PATENT DOCUMENTS

| | | | | |
|---|---|---|---|---|
| 4,836,397 | A | | 6/1989 | Fowles |
| 4,889,256 | A | | 12/1989 | Fowles |
| 4,903,855 | A | | 2/1990 | Ducay et al. |
| 5,092,488 | A | * | 3/1992 | Pradel ..... 220/600 |
| 5,165,560 | A | | 11/1992 | Ennis, III et al. |
| 5,284,263 | A | | 2/1994 | Papciak |
| 5,323,517 | A | | 6/1994 | Su |
| 5,332,113 | A | | 7/1994 | Kusler, III et al. |
| 5,377,853 | A | | 1/1995 | Papciak |
| 5,391,150 | A | | 2/1995 | Richmond |
| 5,498,253 | A | | 3/1996 | Aswad et al. |
| 5,538,154 | A | | 7/1996 | Von Holdt |
| 5,620,433 | A | | 4/1997 | Aswad et al. |
| 5,649,645 | A | | 7/1997 | Demarest et al. |
| 5,690,241 | A | | 11/1997 | Montgomery |
| 5,788,099 | A | | 8/1998 | Treu et al. |
| 6,138,847 | A | | 10/2000 | Johnson |
| 6,234,335 | B1 | | 5/2001 | Gee et al. |
| 6,460,231 | B2 | | 10/2002 | Bourgerie |
| 6,619,492 | B2 | | 9/2003 | Battegazzore |
| 6,792,977 | B2 | | 9/2004 | Presby |
| 6,793,076 | B1 | * | 9/2004 | Luo et al. ..... 206/521 |
| 6,868,978 | B2 | | 3/2005 | Amschlinger et al. |
| 6,871,759 | B2 | | 3/2005 | Rake et al. |
| 2004/0039366 | A1 | | 2/2004 | MacLeod |
| 2006/0092013 | A1 | | 5/2006 | Hager et al. |
| 2006/0138070 | A1 | | 6/2006 | Domkowski et al. |
| 2006/0184103 | A1 | | 8/2006 | Paproski et al. |
| 2006/0201906 | A1 | | 9/2006 | Kraus |

FOREIGN PATENT DOCUMENTS

| | | | |
|---|---|---|---|
| EP | 1044670 | A1 | 10/2000 |
| WO | 9303702 | A1 | 3/1993 |

* cited by examiner

SNAP-OVER CLAMSHELL PROTECTIVE PORT CAP

CROSS-REFERENCE TO RELATED APPLICATIONS

This application claims the benefit of priority to U.S. Provisional Patent Application Ser. No. 60/986,341, filed on Nov. 8, 2007, the entirety of which is hereby incorporated by reference.

BACKGROUND OF THE INVENTION

The present invention relates to the field of containers for administering medical fluids to patients. More particularly, the present invention relates to a snap-over clamshell protective port cap for intravenous (IV) fluid containers.

Access ports are commonly used in infusion solution containers to administer solutions to a patient, or to add medicaments or other solutions to the container prior to administration. Current solution containers typically may include a dedicated outlet port for solution administration to a patient and a dedicated inlet port for the addition of diluent or other ingredients to the container. These ports are conventional in the art and may be of different types of construction but typically have an annular flange. The ports are in fluid communication with the container, usually via an attached tube having a diameter smaller than the port flange.

The outlet port is intended to be coupled to an administrative set and is therefore commonly referred to as the administrative port, whereas the inlet port is designed to permit the injection of therapeutic agents and nutrients into the partially filled container and is sometimes identified as the additive or injection port. Such a container may contain a partial filling of a sterile solution such as water, saline, dextrose or a combination thereof to function as a diluent for the injected additive. The diluted drug or nutrient is then administered to a patient by means of the administrative set that may be either directly or indirectly (i.e., through another solution set) coupled to the patient.

Maintaining the integrity of medication solutions to be administered to a patient is of major importance. It has been found, however, that careless or inattentive handling of a solution container may create significant risks of drug administration errors. Such errors include duplicate administrations of the same substance (overdosing) as well as mis-administration of the wrong substance. These risks may be increased where emergency situations are presented that require quick manipulation of the various components and quick addition of one or more substances to a container via the additive port. In extreme circumstances, a person may intentionally seek to harm a patient by adding one or more agents. Likewise, one could deliberately remove properly mixed solutions via the additive port for illicit purposes. It is imperative that evidence of such tampering be readily apparent to caregivers or their supervisors.

Current methods of making notification of a previous drug administration include placing an adhesive label over the face of the port or onto the container itself. Adhesive labels are not mechanically attached to the port or the container, may be removed, and do not offer any resistance to subsequent needle penetration.

Therefore, an object of this invention is to provide an additive port cap closure that is readily available and easy to place on a port, fully covering the same, upon the completion of prescribed drug admixtures.

A further object of the invention is to provide an additive port cap closure that cannot be removed without damaging the cap and/or the underlying port, and/or leaving visible evidence of tampering.

Another object of the invention is to provide an additive port cap closure that is puncture resistant so as to deter the administration or removal of one or more substances via syringe after the cap is in place.

Yet another object of the invention is to provide an additive port cap closure that is easy and inexpensive to manufacture.

These and other objects will be apparent to those skilled in the art.

SUMMARY OF THE INVENTION

A snap-over clamshell protective port cap is provided for use primarily in clinical healthcare settings, such as hospital pharmacies. Specifically, the cap is designed to be placed over an injection or additive port on a conventional IV fluid container or the like.

In a typical scenario, one or more substances are added to the container through the injection port using a conventional syringe. In order to deter unwanted or erroneous drug administrations or withdrawals, the snap-over port cap is immediately placed over the injection or additive port. The cap is intended for a single use, is disposable and cannot be removed, tampered with or compromised without damaging the cap or at the very least conspicuously stressing or deforming the cap material to give a visible indicator of the disrupting activity.

The cap comprises two cylindrical halves connected by a hinge. The end of each half cylinder opposite the hinge has a complementary component of an interlocking snap. The first half of the cap comprises roughly one half of a cylindrical skirt, a puncture-resistant, circular lid portion, and a flange, while the second half comprises the remaining one half of the cylindrical skirt and a corresponding flange. In use, an open cap is placed about an injection port such that the injection surface of the port is obscured or covered by the lid portion. The halves are pivoted toward one another about the hinge and the interlocking snap is engaged.

The diameter of the lid portion is larger than the diameter of the access site about the port, covering that portion of the port utilized for administrations. Upward axial movement relative to the port is deterred by the engagement between the flange on the cap and the flange about the port, and the cap is maintained in place.

Attempts to forcibly remove the cap from the port will cause visible deformation or destructive change to the cap, particularly to the latch tabs and the hinge, and possibly to the port and/or the container.

DETAILED DESCRIPTION OF THE PREFERRED EMBODIMENT

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
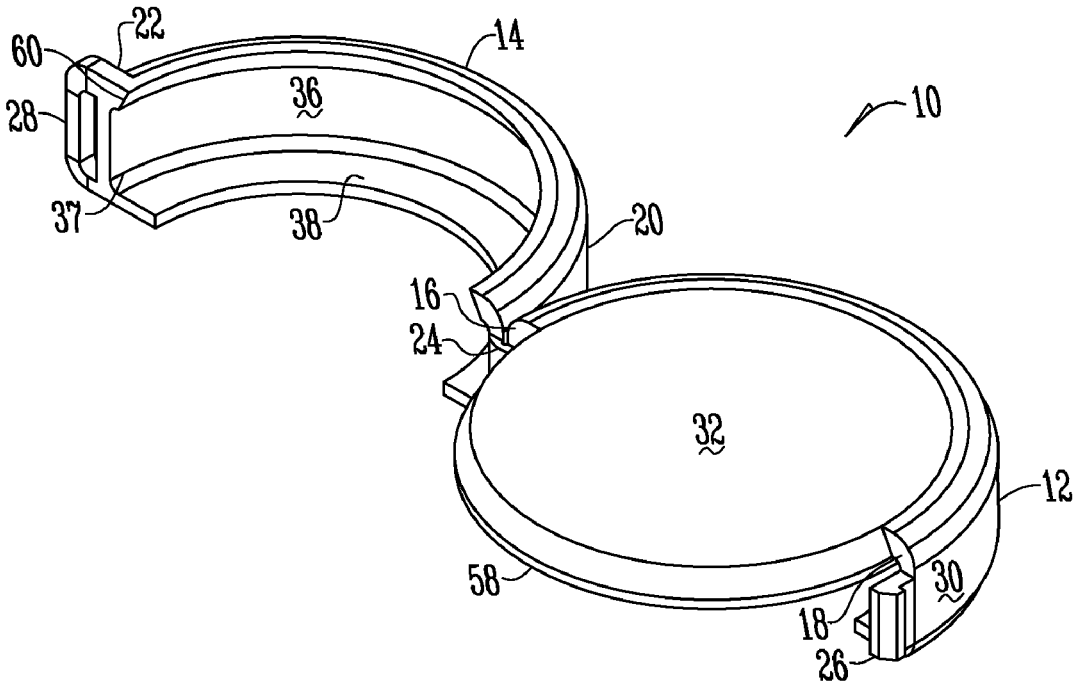
FIG. 1 is a perspective view of a clamshell protective port cap.

Referring to FIG. 1, clamshell cap 10 comprises a first half 12 and a second half 14. It will be understood from the drawings and description that the terms 'first half' and 'second half' as used herein refer to portions or functional members of cap 10, and the term 'half' in this context is not used in a strict literal sense to mean a given quantity or percentage of cap 10. First half 12 has a hinge end 16 and a snap end 18. Second half 14 has a hinge end 20 and a snap end 22. Hinge 24 is attached to hinge end 16 of first half 12 and hinge end 20 of second half 14, such that first and second halves 12, 14 are hingedly or pivotably attached. Without limitation, "hinge" herein should be interpreted to include any number of conventional hinges or other structural connections that permit hinging or pivoting motion about an axis. First snap portion 26 is attached to snap end 18. Second snap portion 28 is attached to snap end 22. First and second snap portions 26, 28 may be complementary members of any conventional interlocking snap, many of which are well known in the art. Once interlocked, snap portions 26, 28 are substantially permanently interlocked, and are designed such that they cannot be easily unlocked without damage, destruction, or visible evidence of tampering.

Figure 2:
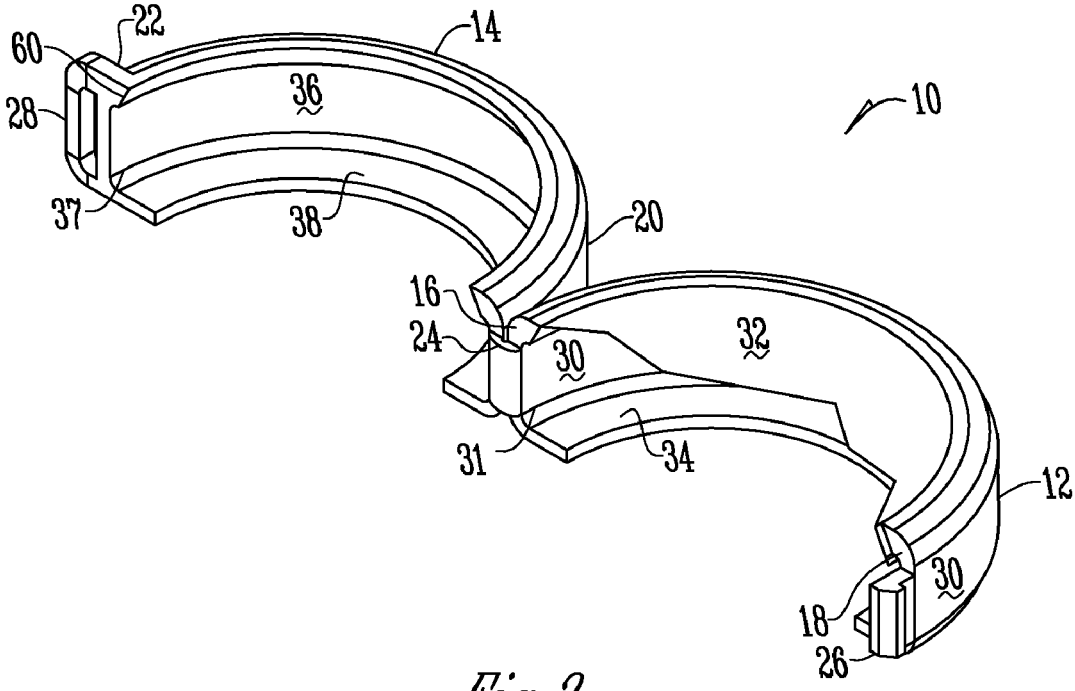
FIG. 2 is a partial cutaway perspective of a clamshell protective port cap.

Also considering FIG. 2, first half 12 further comprises a cylindrical skirt portion 30, a roughly circular lid portion 32, and a flange 34, the flange 34 extending inwardly from the base 31 of cylindrical skirt portion 30 in a plane essentially parallel to the plane defined by lid portion 32. Second half 14 comprises a cylindrical skirt portion 36 that is substantially a mirror image of cylindrical skirt portion 30, and a flange 38 extending inwardly from the base 37 of cylindrical skirt portion 36 that is substantially a mirror image of flange 34. However, other generally complementary or even cooperative relationships between skirt portions 30, 36 will not detract from the invention.

Figure 3:
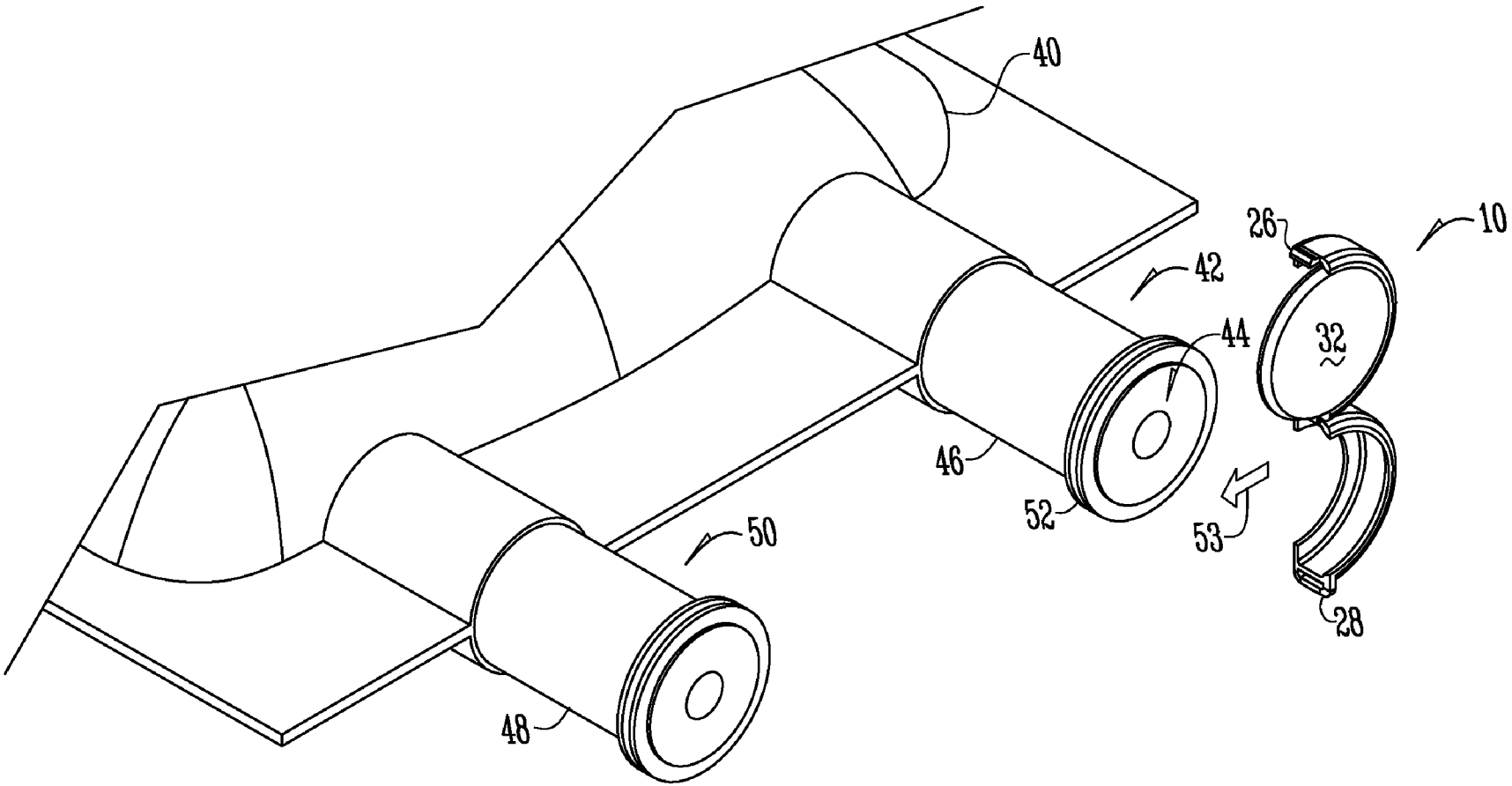
FIG. 3 is a perspective view illustrating a clamshell protective port cap being positioned about a conventional port.

As shown in FIG. 3, conventional solution container 40 has an inlet port 42, an access site 44 on inlet port 42, an inlet tube 46, an outlet tube 48 and an outlet port 50. Access site 44 is typically centrally located about inlet port 42 and commonly referred to as a reseal element or reseal member; 'access site' is used herein to denote that portion of the port through which substances are administered, without limitation. Situated about inlet port 42 is annular flange 52.

In use, first half 12 of open cap 10 is placed about an injection port 42 such that the injection surface or access site 44 of port 42 is obscured or covered by lid portion 32, and flange 34 is situated about an equivalent circumference of injection port flange 52 and is partially around inlet tube 46. Still referring to FIG. 3, cap 10 is positioned such that by moving cap 10 in the direction of arrow 53, lid portion 32 will cover injection surface 44. Alternatively, second half 14 of open cap 10 is placed about injection port 42 such that flange 38 is situated about an equivalent circumference of injection port flange 52 and is partially around inlet tube 46.

Figure 4:
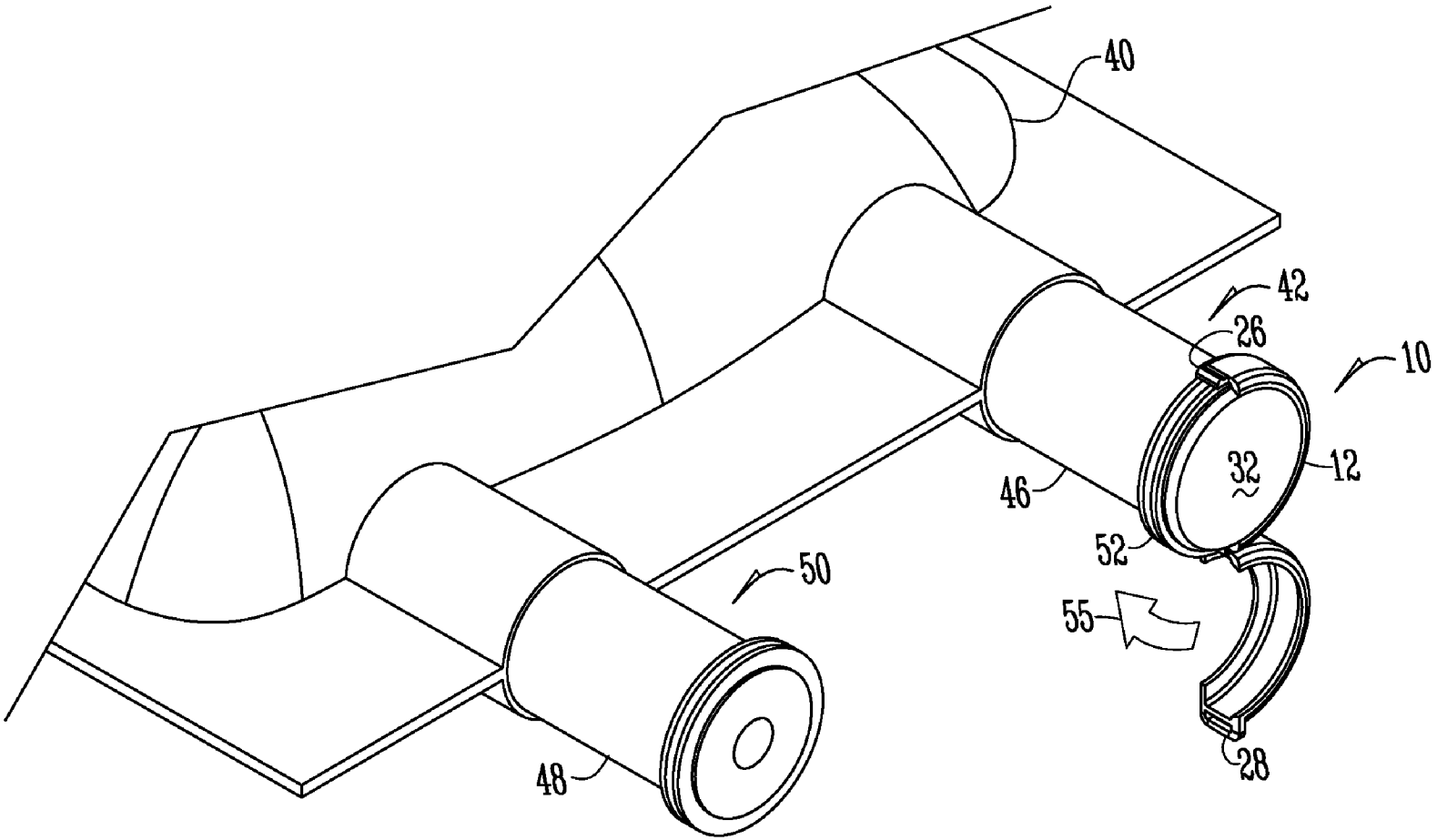
FIG. 4 is a perspective view of a clamshell protective port cap in place about a conventional port.

In the first instance, as illustrated in FIG. 4, second half 14 is folded toward first half 12 about hinge 24, in the direction of arrow 55 and over injection port 42, so that second snap portion 28 engages first snap portion 26. It will be appreciated that in the second instance, first half 12 is folded toward second half 14 about hinge 24, over injection port 42, so that first snap portion 26 engages second snap portion 28. Upon engagement of interlocking snap portions 26, 28, a closed cap 10 is provided. It should be understood that no limitation is intended herein as to whether a particular half should or could be applied to the port first, or whether open cap 10 should or could be centered about a port (i.e., neither half is positionally favored) prior to closing.

Figure 5:
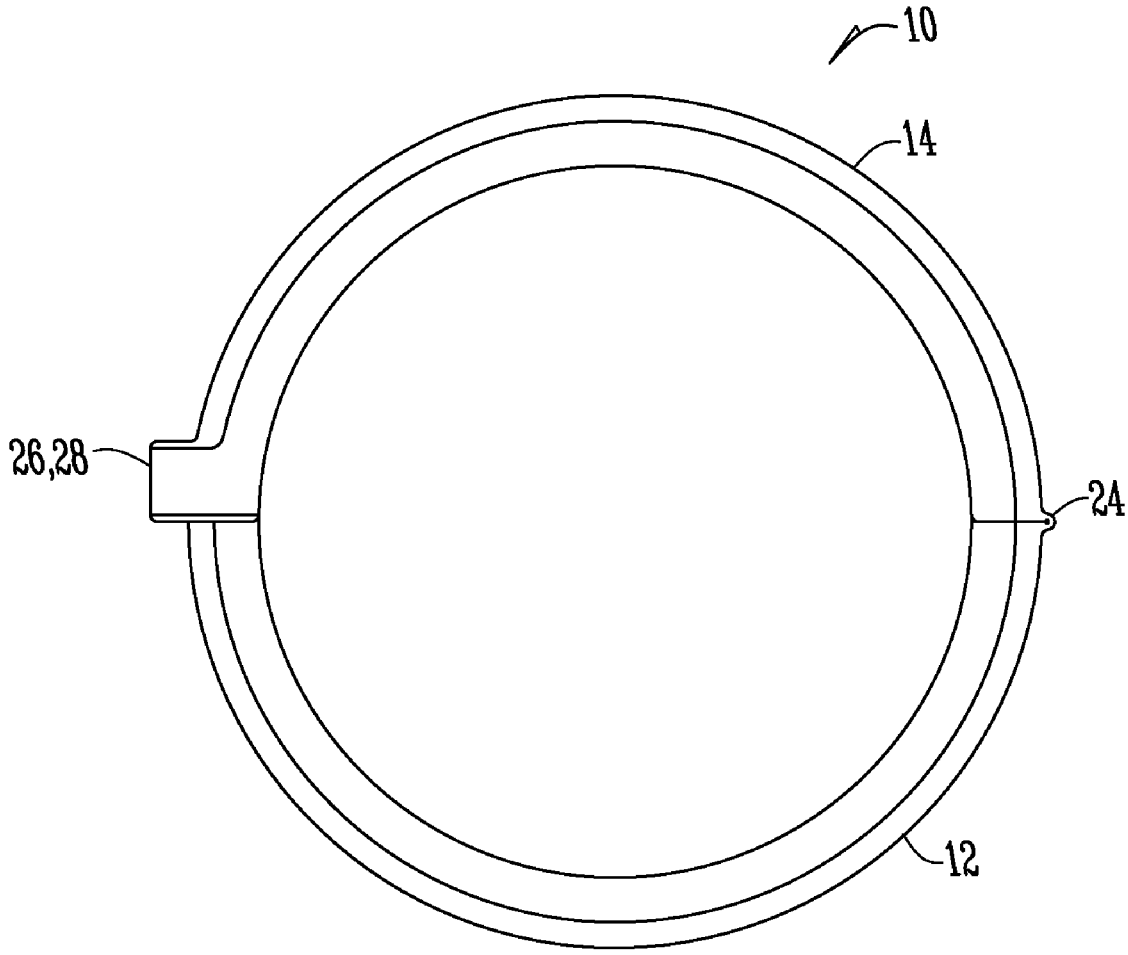
FIG. 5 is a top plan view of a clamshell protective port cap in place about a conventional port.
Figure 6:
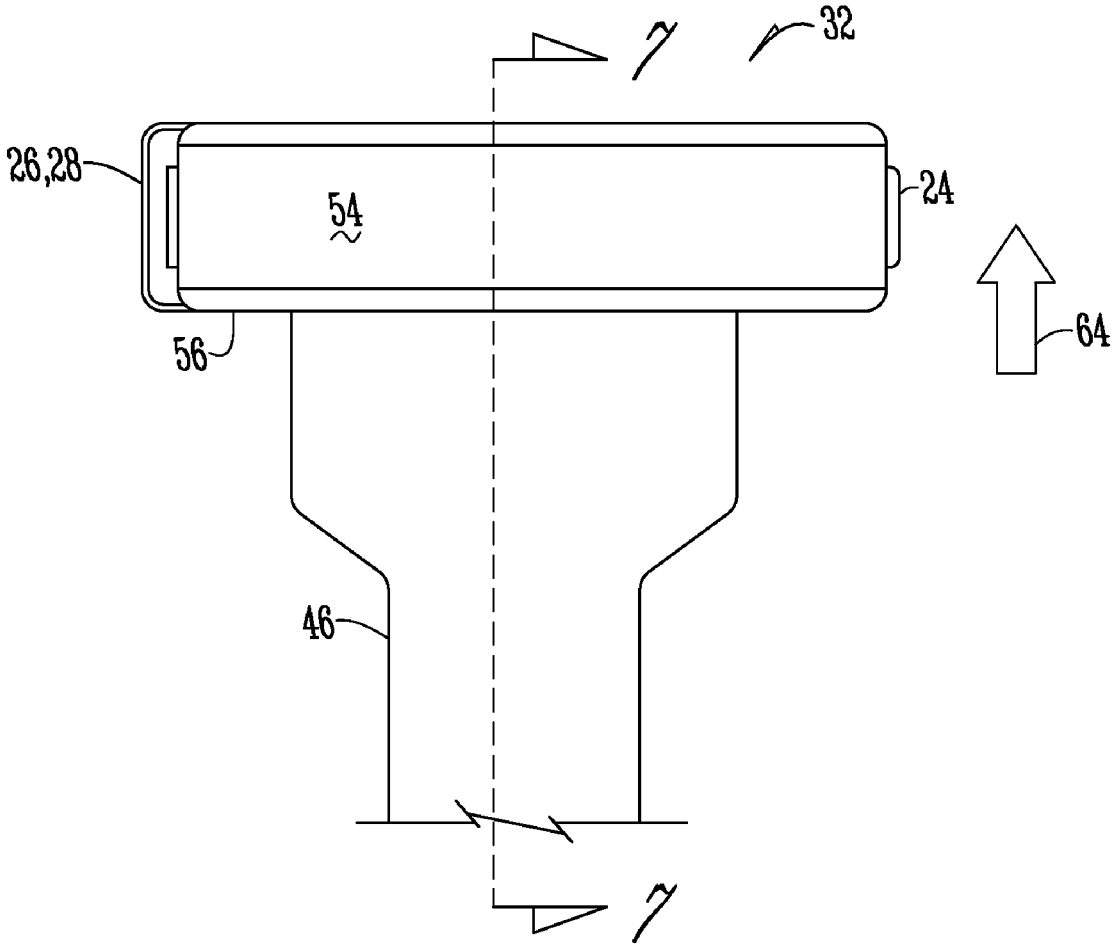
FIG. 6 is a side plan view of a clamshell protective port cap in place about a conventional port.

Turning to FIGS. 5 and 6, in a closed position about injection port 42 (not visible), cylindrical skirt portions 30, 36 (FIGS. 1 and 2) of cap 10 are complementary and meet to form a closed cylindrical skirt 54. Likewise, as can be understood in view of FIGS. 1, 2, 5, 6 and 7, flange 34 and flange 38 of cap 10 are complementary and when cap 10 is closed meet at their respective ends, forming a closed annular flange 56. Closed annular flange 56 defines an inner aperture smaller in diameter than lid portion 32 and flange 52 about injection port 42, but larger in diameter than inlet tube 46. Unlike various protective caps known in the art, the interior of cap 10 between lid portion 32 and closed annular flange 56 is devoid of gripping members such as teeth or ridges that engage injection port 42.

When closed, cap 10 may rotate freely about injection port 42, but closed annular flange 56 prevents cap 10 from being axially removed from injection port 42. Cylindrical skirt 54 is constructed of a substantially rigid material, such as polypropylene or suitable plastic. Lid portion 32 is also constructed of a rigid material, such as polypropylene or suitable plastic, and is preferably of sufficient thickness to provide puncture resistance to conventional clinical needles. Cap 10 may be molded as a unitary piece using conventional techniques.

The diameter of lid portion 32 is larger than the diameter of access site 44, such that when cap 10 is in place, lid portion 32 fully covers access site 44. Lid portion 32 is preferably unitary or of one-piece construction, such that there are no gaps, spaces or seams about that portion of lid portion 32, generally the center, that corresponds to access site 44 of injection port 42.

Approximately one half of the circumference of lid portion 32 adjoins first cylindrical skirt portion 30 of first half 12. The remaining approximate one half of the circumference of lid portion 32 extends in a cantilevered manner from the first-mentioned portion and is free from (i.e., does not adjoin) skirt portion 30. This free circumference 58 is preferably beveled, as shown in FIG. 1. The end 60 of second cylindrical skirt portion 36 of second half 14 opposite of flange 38 is also beveled, as shown in FIG. 1.

Beveled circumference 58 of lid portion 32 and beveled end 60 of second cylindrical skirt portion 36 interlock when first half 12 and second half 14 are closed about hinge 24. In one embodiment, shown in cross-section in FIG. 7, beveled end 60 and beveled circumference 58 each have a corresponding vertical portion 62 adjacent, and in addition, to the provided bevel. It will be appreciated that the combination of the bevel and vertical portion 62 enhances the interlocking between lid portion 32 and second cylindrical skirt portion 36. Furthermore, directing the bevel away from access site 44 of injection port 42 helps to ensure that cap 10 cannot be compromised, for example by needle penetration at the junction between lid and skirt. Although straight vertical complementary portions are shown in FIG. 7, other shapes and orientations can be used, including but not limited to curves, radiuses, and non-vertical straight or undulating surfaces.

Figure 7:
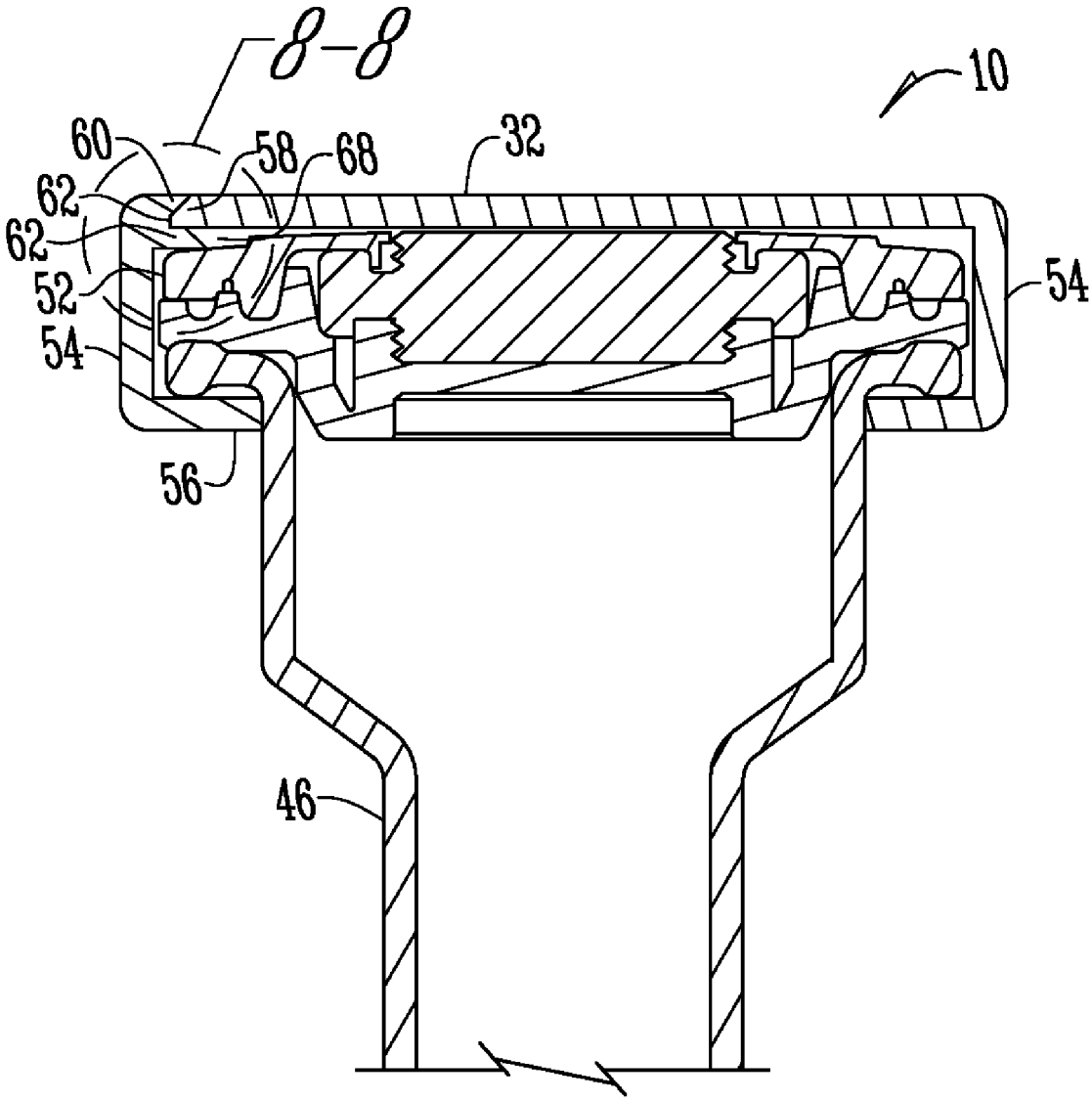
FIG. 7 is a cross-section of a clamshell protective port cap in place about a conventional port, taken along line 7-7 of FIG. 6.
Figure 8:
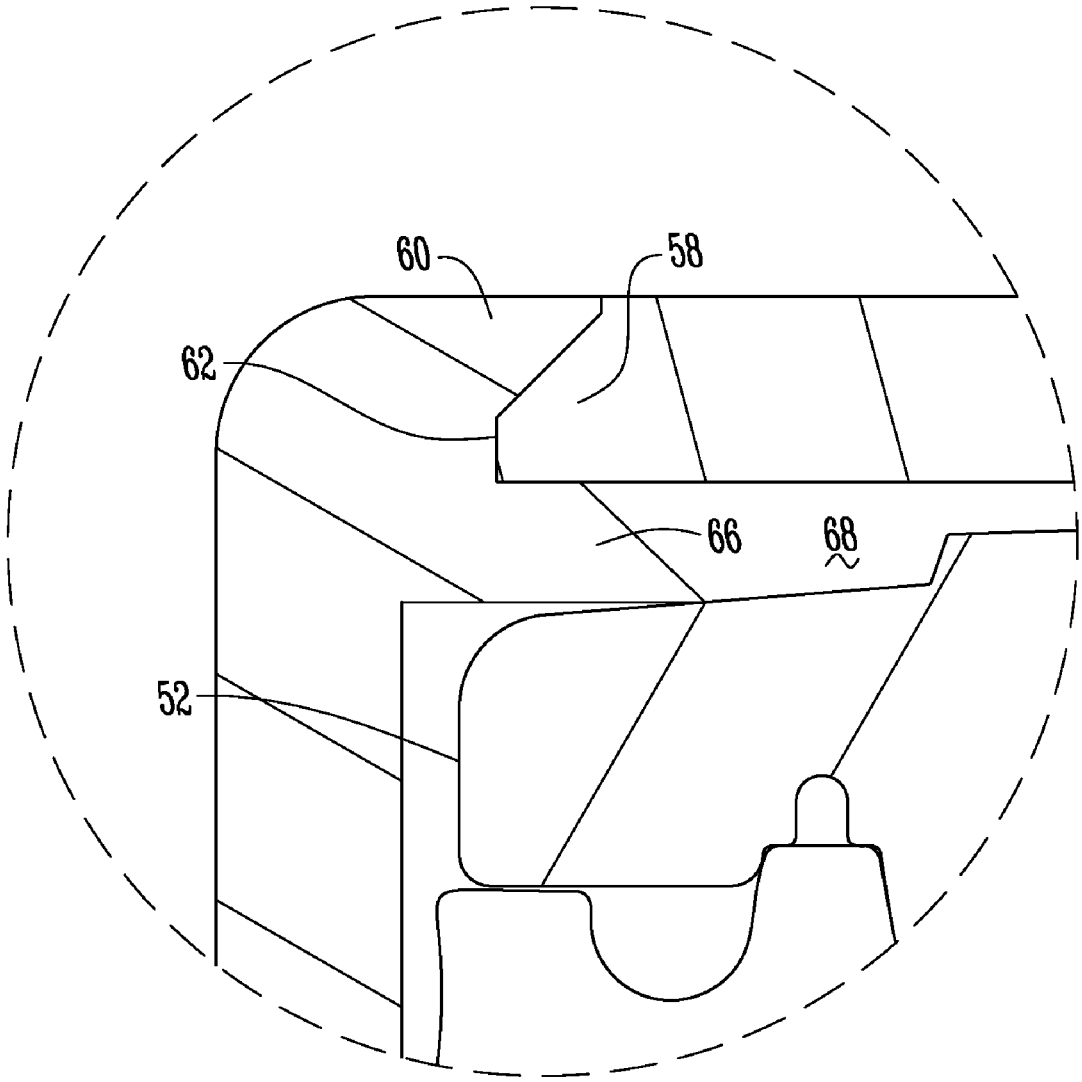
FIG. 8 is a partial cross-section illustrating in detail the interlocking structure of the lid portion and skirt portion of the clamshell protective port cap of FIG. 7.

Optionally, as shown in FIG. 7 and in detail in FIG. 8, a rib 66 on second cylindrical skirt portion 36 projects inwardly adjacent to and below vertical portion 62. Beveled end 60, vertical portion 62, and rib 66 on skirt portion 36 together define a notch 68 that receives, more preferably guides, and most preferably mates with beveled circumference 58 of lid portion 32. Rib 66 also helps support circumference 58. Thus, lid portion 32 can be brought into proper engagement with skirt portion 36 despite minor waviness or variations in alignment or orientation of lid portion 32 due to molding. In one embodiment, rib 66 is provided with a beveled upper surface at its inward leading edge. This facilitates the engagement of circumference 58 and the guidance of circumference 58 into notch 68.

Once all desired medications, drugs and other substances have been added to container 40 in any conventional manner, cap 10 is placed over injection port 42 with lid portion 32 facing outward and with the interior of cap 10 facing injection port 42. Thereafter, removal of cap 10 is deterred due to interference between closed annular flange 56 and flange 52 about injection port 42.

Referring back to FIGS. 6 and 7, it should be appreciated that if one attempts to remove cap 10 by applying axial pulling force in the direction of arrow 64, closed annular flange 56 will engage flange 52 and deter further axial movement. Rotational movement of cap 10 about injection port 42 is possible, but this is not a limitation. Depending upon the structure of injection port 42 and/or the thickness of flange 52, cap 10 may or may not freely rotate.

Snap portions 26, 28 serve as tensile stress concentrators. Attempts to forcibly open cap 10 will result in the fracture of one or both snap portions 26, 28 or at the very least cause a visible deformation of one or more portions of snap portions 26, 28, as well as closed cylindrical skirt 54. Deformations could include, but are not limited to, discoloration, stressing, and creasing. Likewise, persons skilled in the art will appreciate that attempts to pry cap 10 away from injection port 42 will result in deformations to cap 10, and could additionally result in deformations and/or destructive changes to injection port 42, inlet tube 46 or even container 40.

Caps 10 may be color coded to facilitate identification of certain types of medical solutions. For example, red caps may be provided for hazardous agents such as oncolytics, while purple caps may be provided for general drug administrations. Persons skilled in the art will appreciate that there are a number of color-coding conventions in the clinical setting, and that there are potentially limitless color combinations.

Whereas, the present invention has been described in relation to the drawings attached hereto, it should be understood that other and further modifications, apart from those shown or suggested herein, may be made within the scope of this invention.

What is claimed is:

1. A snap-over clamshell cap for a port having a flange, comprising:

a first half comprising a portion of a cylindrical skirt having a base, a unitary circular lid portion adjoined to said cylindrical skirt at an end of said skirt opposite said base, a flange extending inwardly from said base, said flange being essentially parallel to said lid portion, and a first interlocking snap member;

a second half comprising a second cylindrical portion of a cylindrical skirt having a base, a second flange extending inwardly from said base, and a second interlocking snap member;

a connecting member between said first and second halves opposite said interlocking snap members;

wherein the cylindrical portion and flange of the first half engage the cylindrical portion and flange of the second half in a complementary manner when the first and second interlocking snap members are connected;

wherein an end of said second cylindrical skirt portion opposite said base is beveled and a circumference of said lid portion not adjoining said first cylindrical skirt portion is beveled; and wherein said beveled end and beveled circumference are complementary such that said beveled end of said second cylindrical skirt portion and said beveled circumference of said lid portion not adjoining said first cylindrical skirt portion are interlocked when said cap is closed about said hinge.

2. The cap of claim 1 wherein said connecting member is a hinge.

3. The cap of claim 1 wherein said flanges engage an injection port so as to prevent axial movement of said cap in a direction away from said port.

4. The cap of claim 1 wherein said cylindrical skirt and said lid portion are substantially rigid.

5. The cap of claim 1 wherein said lid portion is puncture resistant.

6. The cap of claim 1 wherein the diameter of said lid portion is greater than the diameter of an access site on said port.

7. The cap of claim 1 wherein the cap is color coded to denote a specific class of substances.

8. The cap of claim 1 further comprising complementary vertical surfaces adjacent said complementary beveling.

9. The cap of claim 1 wherein the portion of said circular lid portion that corresponds to an access point on a port below is devoid of seams.

10. The cap of claim 1 wherein an interior of said cap is devoid of teeth and ridges for engaging a port.

11. The cap of claim 1 further comprising a rib formed on said second cylindrical skirt portion, said rib extending inwardly to support said lid portion when said first and second interlocking snap members are connected.

12. The cap of claim 11 wherein said rib has a beveled upper surface at an inward leading edge.

* * * * *